United States Patent [19]

Balde et al.

[11] 4,332,433

[45] Jun. 1, 1982

[54] TERMINATION OF FLAT FLEXIBLE CABLES

[75] Inventors: John W. Balde, Flemington, N.J.; Robert A. Spencer, Indianapolis; Richard K. Thompson, Jr., Carmel, both of Ind.

[73] Assignees: Western Electric Co., Inc., New York, N.Y.; Bell Telephone Laboratories, Murray Hill, N.J.

[21] Appl. No.: 135,401

[22] Filed: Mar. 31, 1980

Related U.S. Application Data

[63] Continuation of Ser. No. 928,930, Jul. 28, 1978, abandoned.

[51] Int. Cl.[3] ..... H01R 13/38

[52] U.S. Cl. ..... 339/99 R; 339/125 R

[58] Field of Search ..... 339/18 C, 97 R, 97 P, 339/98, 99 R, 119 R, 125 R

[56] References Cited

U.S. PATENT DOCUMENTS

| | | | |
|---|---|---|---|
| 3,761,869 | 9/1973 | Hardesty et al. | 339/99 R |
| 3,803,533 | 4/1974 | Taplin | 339/125 R |
| 3,874,766 | 4/1975 | Mizusawa | 339/125 R |
| 3,934,072 | 1/1976 | Balde | 174/48 |
| 3,960,430 | 6/1976 | Bunnell et al. | 339/97 C |
| 3,986,764 | 10/1976 | Torburn | 339/119 R |
| 4,030,801 | 6/1977 | Bunnell | 339/121 |
| 4,066,319 | 1/1978 | Baker et al. | 339/97 R |
| 4,068,912 | 1/1978 | Hudson, Jr. et al. | 339/99 R |
| 4,127,312 | 11/1978 | Fleischhacker et al. | 339/99 R |
| 4,140,885 | 2/1979 | Verhagen | 339/18 C |
| 4,150,867 | 4/1979 | Knickerbocker | 339/97 P |

*Primary Examiner*—Joseph H. McGlynn

*Attorney, Agent, or Firm*—M. Pfeffer; A. S. Rosen

[57] ABSTRACT

Techniques for terminating one or more flat flexible cables (38A,38B) are disclosed. A floor plate (21) used in such terminating is adapted to receive one or more insulation-piercing connectors (28) in one or more recesses (27) in an upstanding wall (26) along an edge of the floor plate. Each connector may alternatively receive, in independent manner and in electrical isolation from one another, either one or two flat flexible cables at the option of a user. Suitable, temporary protective cover (61) and final housing (71) facilities are also disclosed.

8 Claims, 11 Drawing Figures

FIG. 1
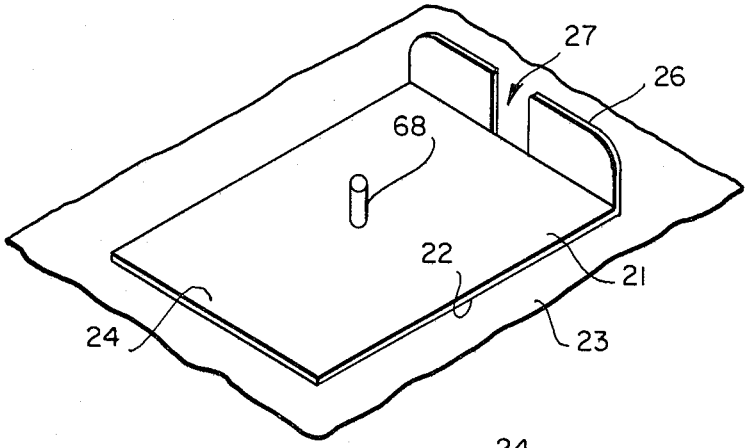
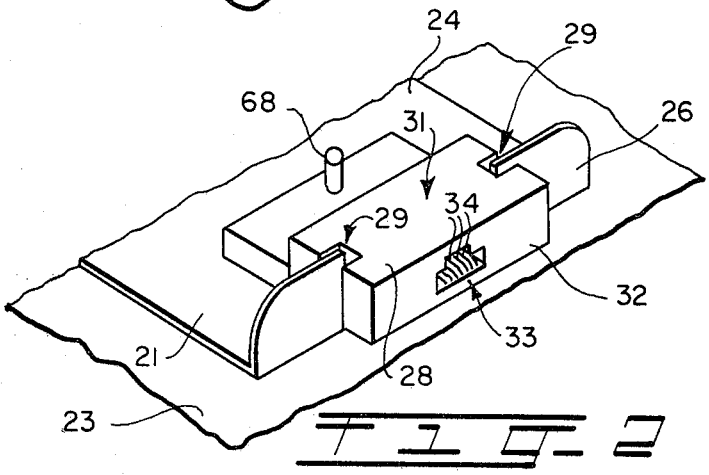
FIG. 2
FIG. 3
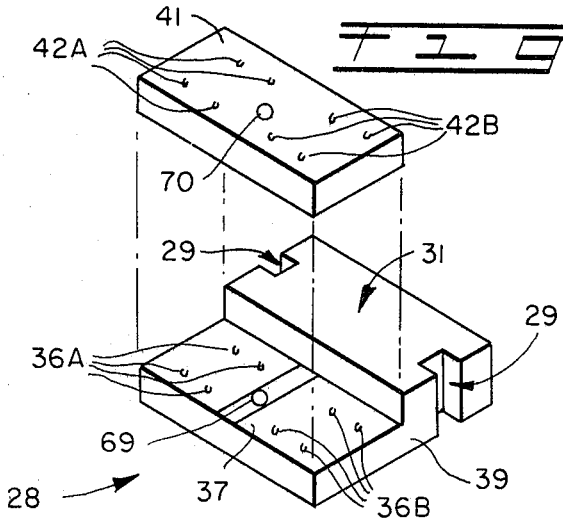

TERMINATION OF FLAT FLEXIBLE CABLES

This is a continuation, of application Ser. No. 928,930 filed July 28, 1978, now abandoned.

BACKGROUND OF THE INVENTION

1. Field of the Invention

The invention relates to terminating one or more flat flexible cables and, more particularly, to connectors and apparatus for terminating one or more flat flexible cables along a substantially flat surface, such as a floor, which terminating may take place prior to the laying of carpeting over both the floor and the terminated, flat flexible cable or cables.

2. Description of the Prior Art

Flat flexible cable structures are known. A typical, flat flexible cable includes a number of spaced, substantially parallel-extending conductors which run along the length of a flat, longitudinally extending, dielectric member, and which form, with the dielectric member, an elongated, flexible article.

It is known also to employ flat flexible cables in various telephone wiring systems within buildings. One or more such cables may be extended along a floor surface to an area at which telephone equipment is to be connected, with a suitable floor covering, typically carpeting, thereafter being laid over the cable in order to hide it from view. Descriptions of such flat flexible cable usage, and of certain associated devices such as connectors, housings, etc., may be found in U.S. Pat. Nos. 3,934,072 and 4,030,801 to J. W. Balde and E. D. Bunnell, respectively.

In the flat flexible cable terminating system disclosed in J. W. Balde U.S. Pat. No. 3,934,072, flat flexible cables are laid along a floor, under a flat peripheral flange at the bottom of a bracket, which bracket is then attached, e.g., by an adhesive material or by fasteners, to the floor. The flat flexible cables extend up through a central opening within the bracket, and into a central connection zone between two spaced, parallel-extending, raised flanges on the bracket. The two raised flanges are adapted to receive opposite ends of up to five female telephone connectors bridging the space between the raised flanges, each connector serving to terminate a different, associated one of the flat flexible cables along multiple pairs of conductors, e.g., up to twenty-five pairs of conductors, in the associated, flat flexible cable.

The flat flexible cable terminating system of E. D. Bunnell U.S. Pat. No. 4,030,801 employs a flat-bottomed base plate, which is attached to a floor by fasteners. Two parallel-extending sidewalls stretch upwardly from the base plate and include laterally-projecting ears for receiving opposite ends of two connectors. Each of the connectors is associated with a different one of two multiple conductor, flat flexible cables which extend parallel to the sidewalls and toward the laterally-projecting ears from opposite ends of the base plate. The base plate, which is adapted to receive only the two multiple conductor, flat flexible cables, is covered, after the termination of the cables and the laying of a carpet over the cables, by a screw-attached housing.

In both J. W. Balde U.S. Pat. No. 3,934,072 and E. D. Bunnell U.S. Pat. No. 4,030,801, the termination of cables for large numbers of telephone lines is envisioned, requiring the use of large connectors for receiving multiple pairs of conductors, e.g., up to twenty-five pairs of conductors, in each flat flexible cable which is to be terminated. Clearly, it would be desirable to provide relatively simple and inexpensive equipments and techniques for terminating flat flexible cables where only a few pairs of conductors, e.g., only two pairs of conductors, are included in each cable.

SUMMARY OF THE INVENTION

The invention is directed to a connector for use in an undercarpet telephone wiring system for interconnecting one of a plurality of contacts of a plug with one of the conductors of one or more flat flexible cables. The number of cables and the interconnection pattern between the plug contacts and the flat cable conductors are determined in accordance with a desired system configuration. The invention also relates to an undercarpet wiring system including the connector and a floor plate which includes an upstanding wall with a recess therein for receiving a portion of the connector.

The connector includes a dielectric, plug-receiving housing having a plug-receiving recess extending inwardly from its front surface. The housing includes a necked region dimensioned to fit within the recess of the floor plate upstanding wall such that portions of the upstanding wall on either side of the recess are captured within the housing to thereby prevent substantial inward or outward movement of the connector. The connector also includes a plurality of jack contacts mounted within the plug-receiving recess for connection with respective ones of the plug contacts. A plurality of conductive terminals equal in number to the number of jack contacts and having first and second ends are mounted in a dielectric, support member extending rearwardly from the rear face of the housing. The support member has a flat upper surface for receiving a flat flexible cable and a spaced lower surface. The terminals are normally electrically isolated from the jack contacts and are mounted such that their respective first ends extend upwardly from the upper surface of the support member and their second ends extend downwardly from the lower surface thereof. The first ends of the terminals are adapted to engage and make electrical contact with respective conductors of a flat cable, while the second ends of the terminals are adapted to engage and make electrical contact with means for connecting the second ends to respective ones of the jack contacts in a pattern determined by the desired system configuration.

BRIEF DESCRIPTION OF THE DRAWING

FIG. 1 of the drawing is an isometric view of a floor plate constructed in accordance with the principles of the invention;

FIG. 2 is an enlarged, isometric view of a rear portion of the floor plate of FIG. 1 with a connector retained in the floor plate;

FIG. 3 is an isometric view of the connector depicted in FIG. 2, showing additional features of the connector and also illustrating a cover which is associated with the connector, the cover being shown removed from the connector;

DETAILED DESCRIPTION

Figure 4:
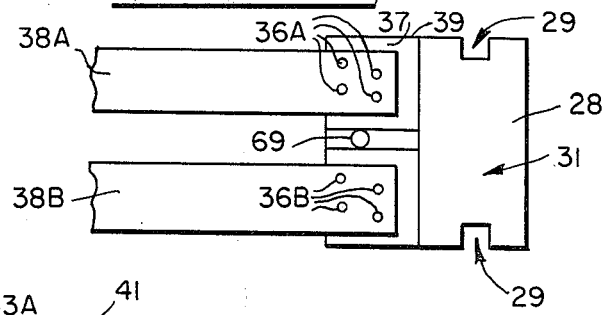
FIG. 4 is a plan view illustrating the manner in which two flat flexible cables may be received by the connector of FIGS. 2 and 3, with the cover removed from the connector.

Referring initially to FIG. 1 of the drawing, a floor plate 21 is shown. The floor plate 21 includes a substantially flat, first or bottom face 22 which may be attached, e.g., by means of an adhesive medium or by mechanical fasteners (not shown) to a substantially flat, floor surface 23. The floor plate 21 also includes a second or upper face 24 and an upstanding wall 26 located along an edge, e.g., a rear edge, of the second face 24. A recess 27 for receiving a connector 28 is located in the upstanding wall 26 of the floor plate 21.

As may be seen in FIGS. 2–4 of the drawing, the connector 28 includes a pair of opposed, recess areas 29,29 so as to define a necked region 31 of the connector 28, at opposite sides of which necked region 31, the connector 28 may be retained by insertion of the connector 28 into the recess 27 in the upstanding wall 26 of the floor plate 21. The connector 28 also includes, along an outwardly-facing, end wall 32 of the connector 28, a recess 33 for receiving a plug, e.g., a modular plug of the type disclosed in U.S. Pat. No. 3,761,869 to E. C. Hardesty et al. A number of electrically conductive, contact elements 34,34 are located within the recess 33 in the end wall 32 of the connector 28, in position to be engaged by a set of electrical conductors in the plug.

The connector 28 preferably includes two sets of electrically conductive, insulation-piercing contacts 36A,36A and 36B,36B (FIGS. 3 and 4) along an upper surface 37 of the connector 28. The contacts 36A,36A of the connector 28 are so disposed as to permit the termination of a first, four wire, flat flexible cable 38A at the contacts 36A,36A, while the contacts 36B,36B of the connector 28 are so disposed as to permit the optional, additional, independent termination of a second, four wire, flat flexible cable 38B at the contacts 36B,36B. A body portion 39 of the connector 28, which is composed of a dielectric material, such as a polycarbonate material, constitutes a housing for the two sets of contacts 36A,36A and 36B,36B, maintaining the various contacts 36A,36A and 36B,36B in electrical isolation from one lanother. In another embodiment, the connector 28 might include only one set of electrically conductive, insulation-piercing contacts 36A,36A, where only a single, flat flexible cable 38A need ever be terminated in the connector 28.

A top cover 41 (FIG. 3) is adapted to be placed over the upper surface 37 of the connector 28 to aid in securing the flat flexible cable 38A or cables 38A and 38B. The top cover 41 includes two suitable sets of apertures 42A,42A and 42B,42B for receiving the two sets of contacts 36A,36A and 36B,36B, respectively.

Figure 5:
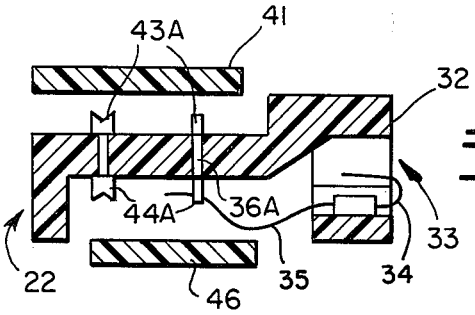
FIG. 5 is a vertical cross-sectional view of the connector of FIGS. 2 and 3, showing further features of the connector.

Turning now also to FIG. 5 of the drawing, one of the representative contacts 36A,36A has been turned through 90° from its true orientation in order to show more clearly the general configurations of insulation-piercing facilities 43A,43A at the top ends of the contacts 36A,36A. Such configurations may be similar to those disclosed in U.S. Pat. No. 4,068,912 to W. J. Hudson, Jr. et al. The contacts 36A,36A preferably also have insulation-piercing facilities 44A,44A at their bottom ends. These additional, insulation-piercing facilities 44A,44A are adapted to be wired by means of wires 35,35 (only one of which is shown), in any suitable pattern, to the electrically conductive, contact elements 34,34 in the recess 33 in the end wall 32 of the connector 28. Similar sets of insulation-piercing facilities would, of course, be present at top and bottom ends of the other contacts 36A,36A and 36B,36B. A bottom cover 46 (FIG. 5) functions in cooperation with the bottom ends of the contacts 36A,36A and 36B,36B in similar manner to the functioning of the top cover 41 with respect to the top ends of the contacts 36A,36A and 36B,36B.

Figure 6:
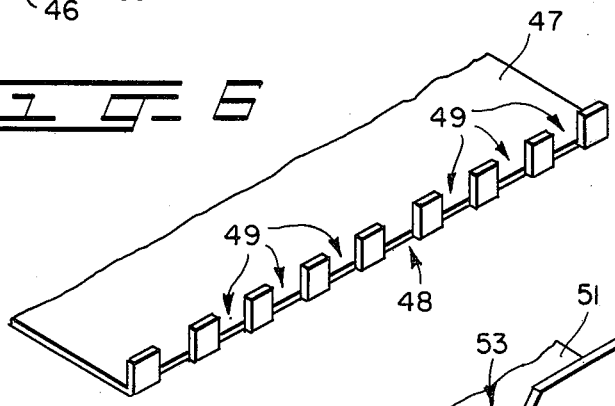
FIG. 6 is an isometric view of a rear portion of an alternative floor plate adapted to receive and retain a plurality of connectors.

A rear portion of an alternative floor plate 47 is shown in FIG. 6. The floor plate 47 has an upstanding wall region 48 located along a rear edge of the floor plate 47. The upstanding wall region 48 includes at least two, and preferably more than two, recesses 49,49 for each receiving and retaining a connector, similar to the connector 28. Thus, any desired number of parallel-extending, flat flexible cables may be terminated at the floor plate 47, depending upon the number of available, connector-receiving recesses 49,49 in the upstanding wall region 48.

Figure 7:
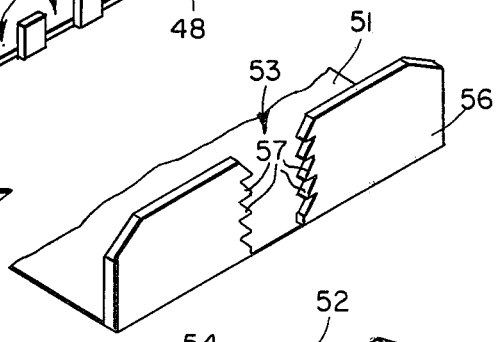
FIGS. 7 and 8 are isometric views of rear portions of two further, alternative floor plate structures.
Figure 8:
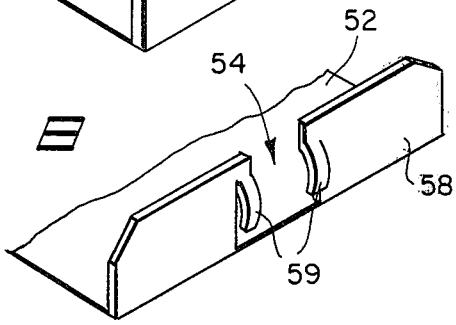

Rear portions of two additional floor plates 51 and 52 are shown, respectively, in FIGS. 7 and 8 of the drawing. Each of these additional floor plates 51 and 52 includes a modified form of recess 53 or 54 for receiving and retaining a connector similar to the connector 28. Thus, the recess 53, which is located in an upstanding wall 56 along a rear edge of the floor plate 51, is bounded by a number of connector-retaining, serrations 57,57 along opposite sides of the recess 53, while the recess 54, which is located in an upstanding wall 58 along a rear edge of the floor plate 52, has a pair of bent, connector-retaining tabs 59,59 located proximate to it. Of course, either of the floor plates 51 and 52 might alternatively include two or more such recesses 53 or 54.

Figure 9:
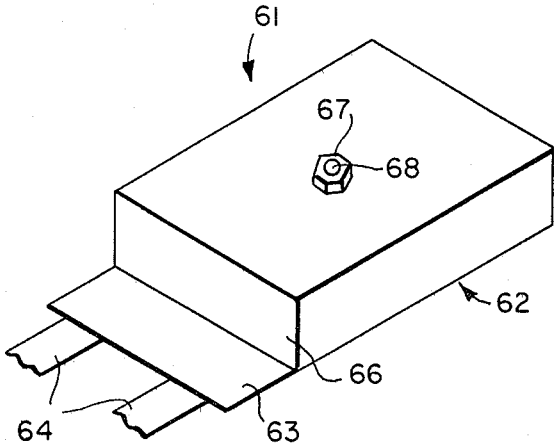
FIG. 9 is an isometric view of a temporary, protective cover which may be utilized with the various floor plate and connector structures according to the invention.

Referring next to FIG. 9 of the drawing, a temporary, protective cover 61 is shown. The cover 61 includes a major portion 62, in the form of a box with an open bottom (not shown), for enveloping a floor plate, such as the floor plate 21 of FIG. 1, and one or more connectors, such as the connector 28 of FIG. 2. The cover 61 (FIG. 9) also includes an outwardly-extending flange 63, located along a bottom edge of the box-shaped, major portion 62 and so disposed as to stretch across one or more flat flexible cables 64,64, which cable or cables is or are terminated in the one or more connectors beneath the major portion 62. The cover 61 will function, during the laying of carpeting over the flat flexible cable or cables 64,64 and connector or connectors, to protect the covered structures. The flange 63, in particular, will serve to protect each flat flexible cable 64 from severance during cutting of the carpeting along an outer edge 66 of the box-shaped, major portion 62 of the cover 61, adjacent to the flange 63. The cover 61 may be attached temporarily, e.g., loosely, to the floor plate 21 (FIG. 1) by means of a nut 67 which may be threaded onto a post 68 extending upwardly from the floor plate 21, e.g., through suitable apertures 69 and 70

(FIG. 3) in the connector 28 and its top cover 41. After carpet-laying, the nut 67 may be removed and the cover 61 may readily be withdrawn upwardly and rearwardly from the slit carpet.

Figure 10:
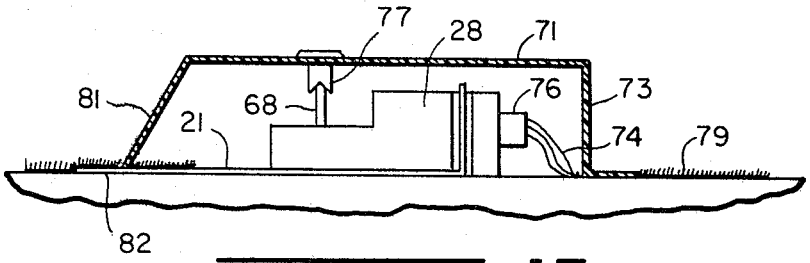
FIG. 10 is a side elevational view, partly in section, of a connector, floor plate and housing arrangement.
Figure 11:
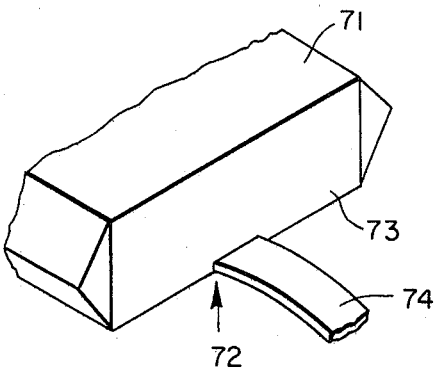
FIG. 11 is an isometric view of a rear portion of the housing illustrated in FIG. 10, showing additional features of the housing.

A permanent housing 71, for enclosing the floor plate 21 of FIG. 1 and the connector 28 of FIG. 2, is shown in FIGS. 10 and 11 of the drawing. The housing 71 includes a slight recess 72 (FIG. 11) along the bottom of a rear wall 73 of the housing 71 to provide clearance for a rearwardly-extending, flat flexible cable 74 associated with a plug 76 (FIG. 10) inserted into the recess 33 (FIG. 2) in the end wall 32 of the connector 28. A bolt or other fastener 77 (FIG. 10) may be tightened onto the post 68 (FIG. 1) of the floor plate 21. Tightening of the fastener 77 causes the rear wall 73 of the housing 71 to clamp the flat flexible cable 74 onto a carpet 79 at the recess 72. Tightening of the fastener 77 also causes a forward wall 81 of the housing 71 and a forward portion 82 of the floor plate 21 to cooperate to clamp a cut portion of the carpet 79 to the fixed floor plate 21.

It is to be understood that the described methods and apparatus are simply illustrative of preferred embodiments of the invention. Many modifications may, of course, be made in accordance with the principles of the invention.

We claim:

1. A connector for use in an undercarpet telephone wiring system for interconnecting one of a plurality of contacts of a plug with one of the conductors of one or more flat flexible cables, the number of cables and the interconnection pattern between the plug contacts and the flat cable conductors being determined in accordance with a desired system configuration, the system including a floor plate having a substantially flat, first face suitable for attachment to a floor and an oppositely-facing, parallel, flat second face for supporting the connector, the second face having an upstanding wall with a recess therein for receiving a portion of the connector, which connector comprises:

(a) a dielectric, plug-receiving housing having front and rear faces, spaced sidewalls extending between the front and rear faces and a plug-receiving recess extending inwardly from the front surface and having a shape complimentary to that of the plug, the sidewalls having opposed notches formed therein intermediate the front and rear faces to thereby define a necked region of the housing, the width of the necked region being less than the width of the recess of the floor plate upstanding wall so that the necked region may be received within the recess, the width between the sidewalls of the housing immediately adjacent to the notches being greater than that of the recess so that portions of the upstanding wall on either side of the recess may be captured within the notches when the connector is supported on the floor plate to thereby prevent substantial inward or outward movement of the connector;

(b) a plurality of jack contacts mounted within the plug-receiving recess, the jack contacts being adapted to engage and make electrical contact with respective ones of the plug contacts;

(c) a dielectric, support member extending rearwardly from the rear face of the housing and connected thereto and having a flat upper surface for receiving a flat flexible cable and a spaced lower surface; and (d) a plurality of conductive terminals equal in number to the number of jack contacts and having first and second ends, the terminals being mounted in the support member such that they are normally electrically isolated from the jack contacts and such that their respective first ends extend upwardly from the upper surface of the support member and their second ends extend downwardly from the lower surface thereof, the first ends of the terminals being adapted to engage and make electrical contact with respective conductors of a flat cable, the second ends of the terminals being adapted to engage and make electrical contact with means for connecting the second ends to respective ones of the jack contacts in a pattern determined by the desired system configuration.

2. Apparatus in accordance with claim 1 wherein the first and second ends are adapted for making electrical contact by respective insulation-piercing means disposed at said ends.

3. Apparatus in accordance with claim 2 further including a cap for cooperating with the first ends to secure a flat flexible cable to the first ends, the cap having a plurality of apertures equal in number to the terminals and arranged in an identical pattern.

4. Apparatus for use in an undercarpet telephone wiring system for interconnecting one of a plurality of contacts of a plug with one of the conductors of one or more flat flexible cables, the number of cables and the interconnection pattern between the plug contacts and the flat cable conductors being determined in accordance with a desired system configuration, which apparatus comprises:

(a) a connector including:

(i) a dielectric, plug-receiving housing having front and rear faces, spaced sidewalls extending between the front and rear faces and a plug-receiving recess extending inwardly from the front surface and having a shape complimentary to that of the plug, the sidewalls having opposed notches formed therein intermediate the front and rear faces to thereby define a necked region of the housing;

(ii) a plurality of jack contacts mounted within the recess, the jack contacts being adapted to engage and make electrical contact with respective ones of the plug contacts;

(iii) a dielectric, support member extending rearwardly from the rear face of the housing and connected thereto and having a flat upper surface for receiving a flat flexible cable and a spaced lower surface; and (iv) a plurality of conductive terminals equal in number to the number of jack contacts and having first and second ends, the terminals being mounted in the support member such that they are normally electrically isolated from the jack contacts and such that their respective first ends extend upwardly from the upper surface of the support member and their second ends extend downwardly from the lower surface thereof, the first ends of the terminals being adapted to engage and make electrical contact with respective conductors of a flat cable, the second ends of the terminals being adapted to engage and make electrical contact with means for connecting said second ends to respective ones of the jack contacts in a pattern determined by the desired system configuration; and (b) a plate having a substantially flat, first face suitable for attachment to a floor and an oppositely-facing, parallel, flat second face for supporting the connector such that the upper and lower surfaces of the support member are parallel to the second face, an upstanding wall located along an edge of the second face, the upstanding wall having a recess therein for receiving the necked region of the plug-receiving housing of the connector such that those portions of the connector extending rearwardly of the necked region extend inwardly of the upstanding wall and those portions of the connector extending forwardly of the necked region extend outwardly of the upstanding wall, the width of the recess being at least equal to the width of the necked region so that the necked region may be received within the recess, but the width being less than the combined width of the necked region and the depths of the notches so that portions of the upstanding wall on either side of the recess are captured within the notches to thereby prevent substantial inward or outward movement of the connector.

5. Apparatus in accordance with claim 4, further including means associated with the recess for restraining the connector from any substantial upward movement after positioning of the necked region within the recess.

6. Apparatus in accordance with claim 4, wherein the plate has a post extending from the first face thereof and the connector has an opening for receiving the post; the apparatus further including a cover for enclosing the connector, the cover having an opening for receiving the post, and means for securing the cover to the post.

7. Apparatus in accordance with claim 6 wherein the first and second ends are adapted for making electrical contact by respective insulation-piercing means disposed at said ends.

8. Apparatus in accordance with claim 7 further including a cap for cooperating with the first ends to secure a flat flexible cable to the first ends, the cap having a plurality of apertures equal in number to the terminals and arranged in an identical pattern.

* * * * *